US006608430B1

(12) United States Patent
Schaus

(10) Patent No.: US 6,608,430 B1
(45) Date of Patent: Aug. 19, 2003

(54) SPARK PLUG WITH MULTI-POINT FIRING CAP

(76) Inventor: Robert J. Schaus, 15026 Oxnard St., Van Nuys, CA (US) 91411

( * ) Notice: Subject to any disclaimer, the term of this patent is extended or adjusted under 35 U.S.C. 154(b) by 31 days.

(21) Appl. No.: 10/013,753

(22) Filed: Dec. 7, 2001

(51) Int. Cl.[7] ..... H01T 13/20
(52) U.S. Cl. ..... 313/140; 313/141
(58) Field of Search ..... 313/139, 140, 313/141, 143

(56) References Cited

U.S. PATENT DOCUMENTS 3,958,144 A * 5/1976 Franks ..... 313/141
5,007,389 A * 4/1991 Kashiwara et al. ..... 123/169
5,264,754 A * 11/1993 Hanitijo ..... 313/139
5,369,328 A * 11/1994 Gruber et al. ..... 313/141
5,554,908 A * 9/1996 Kuhnert et al. ..... 313/140
5,563,468 A * 10/1996 Abe et al. ..... 313/141
5,623,179 A * 4/1997 Buhl ..... 313/141
6,060,822 A * 5/2000 Krupa et al. ..... 313/141
6,329,743 B1 * 12/2001 Camilli ..... 313/141
6,414,419 B1 * 7/2002 Kim ..... 313/141

* cited by examiner

*Primary Examiner*—P. Austin Bradley
*Assistant Examiner*—Ross Gushi
(74) *Attorney, Agent, or Firm*—Goldstein & Lavas PC

(57) ABSTRACT

Provided is a spark plug that includes a central electrode having a proximal end and a distal end and a cap having a central portion and plural projections extending radially from the central portion. The cap has a proximal side and a distal side, and the proximal side of the cap is attached to the distal end of the central electrode. The cap is electrically conductive, having a first electrical conductivity. A central portion of the cap defines a hole and has a thickness in a location of the hole, and the central electrode extends into the hole of the cap but terminates prior to the distal side of the cap. A filler material, which may have been deposited as a fusion medium, is disposed within a portion of the hole that is not occupied by the central electrode, with the filler material having a second electrical conductivity that is lower than the first electrical conductivity.

37 Claims, 16 Drawing Sheets

BEND FOR THE 14MM STAR

12 MM

14 MM

14 MM

14 MM

SPARK PLUG WITH MULTI-POINT FIRING CAP

BACKGROUND OF THE INVENTION

1. Field of the Invention

The present invention relates to spark plugs for use in internal combustion engines and, more particularly, to a spark plug having a star-shaped or a multi-point firing cap.

2. Description of the Related Art

The most common type of conventional spark plug has a central electrode spaced at a specified gap from a L-shaped electrode. The L-shaped electrode is electrically connected to an outer metallic shell of the spark plug that contacts the engine, providing an electrical ground for the spark plug. When the spark plug fires, a spark jumps between the central electrode and the L-shaped ground electrode.

Such conventional spark plugs serve their purpose of igniting the air/fuel mixture in an internal combustion engine. However, the present inventor has discovered that there is significant room for increasing combustion efficiency, and thereby also reducing engine emissions, engine operating temperature and damage resulting from combustion within the exhaust system, through the use of improved spark plug technology.

Various conventional spark plug designs have been proposed. However, none has been found to adequately address these problems.

SUMMARY OF THE INVENTION

The present invention addresses such problems by providing a spark plug that generally is capable of firing multiple sparks simultaneously. In this regard, while some conventional spark plugs have multiple points that are capable of sparking, the present inventor has discovered that such conventional spark plugs nevertheless only reliably fire from one point at a time. It is believed that slight physical differences cause one of the points to be the path of least resistance and, once that point fires, the ionization of air within the gap corresponding to that point reduces the path resistance even further, precluding the other points from firing. In such conventional spark plugs, when the firing point has become sufficiently fouled, its resistance to firing becomes great enough that one of the other points becomes the path of least resistance and it fires instead. As a result, only one point fires at a time, leading to less than optimal combustion within a cylinder. The present invention addresses this problem in the following manner.

In one aspect, the invention is directed to a spark plug that includes a central electrode having a proximal end and a distal end and a cap having a central portion and plural projections extending radially from the central portion. Thus, in one embodiment the cap is star-shaped and may be bent into a dome shape. The cap has a proximal side and a distal side, and the proximal side of the cap is attached to the distal end of the central electrode. The cap is electrically conductive, having a first electrical conductivity. A central portion of the cap defines a hole and has a thickness in a location of the hole, and the central electrode extends into the hole of the cap but terminates prior to the distal side of the cap. A filler material, which may have been deposited as a fusion medium, is disposed within a portion of the hole that is not occupied by the central electrode, with the filler material having a second electrical conductivity that is lower than the first electrical conductivity.

In a further aspect, the invention is directed to a spark plug that includes a central electrode having a proximal end and a distal end and a cap having a central portion and plural projections extending radially from the central portion. The cap has a proximal side and a distal side and the proximal side of the cap is attached to the distal end of the central electrode. The cap is comprised mostly of a first material having a first electrical conductivity and also of a second material having a second electrical conductivity that is lower than the first electrical conductivity, with the second material being disposed toward the distal side of the cap.

By virtue of the foregoing arrangements, a spark plug according to the present invention often can provide multiple simultaneous sparks, frequently at least one from each radial projection. As a result, more efficient combustion often can occur, yielding improved efficiency and reduced emissions of certain types of pollutants. In addition, more efficient combustion reduces the likelihood of combustion within the exhaust system, thereby reducing damage from such combustion and reducing engine operating temperature.

The present invention also concerns improved spark plug manufacturing. Thus, in a still further aspect, the invention is directed to a method for manufacturing a spark plug. A cap is fabricated, the cap having a central portion and plural projections extending radially from the central portion, with the central portion of the cap defining a hole through the cap and with the hole having a depth. An electrode is inserted into the hole, but only through a portion of the depth of the hole, and the cap and the electrode are heated so that fusion begins to occur. Attachment material is then deposited so as to fill at least a portion of the depth of the hole not occupied by the electrode.

The above method often can efficiently provide a spark plug that is capable of firing from multiple radial projections simultaneously, thereby improving combustion efficiency and providing the associated benefits described above.

The foregoing summary is intended merely to provide a brief description of the general nature of the invention. A more complete understanding of the invention can be obtained by referring to the claims and the following detailed description of the preferred embodiments in connection with the accompanying figures.

DESCRIPTION OF THE PREFERRED EMBODIMENT(S)

Figure 1:
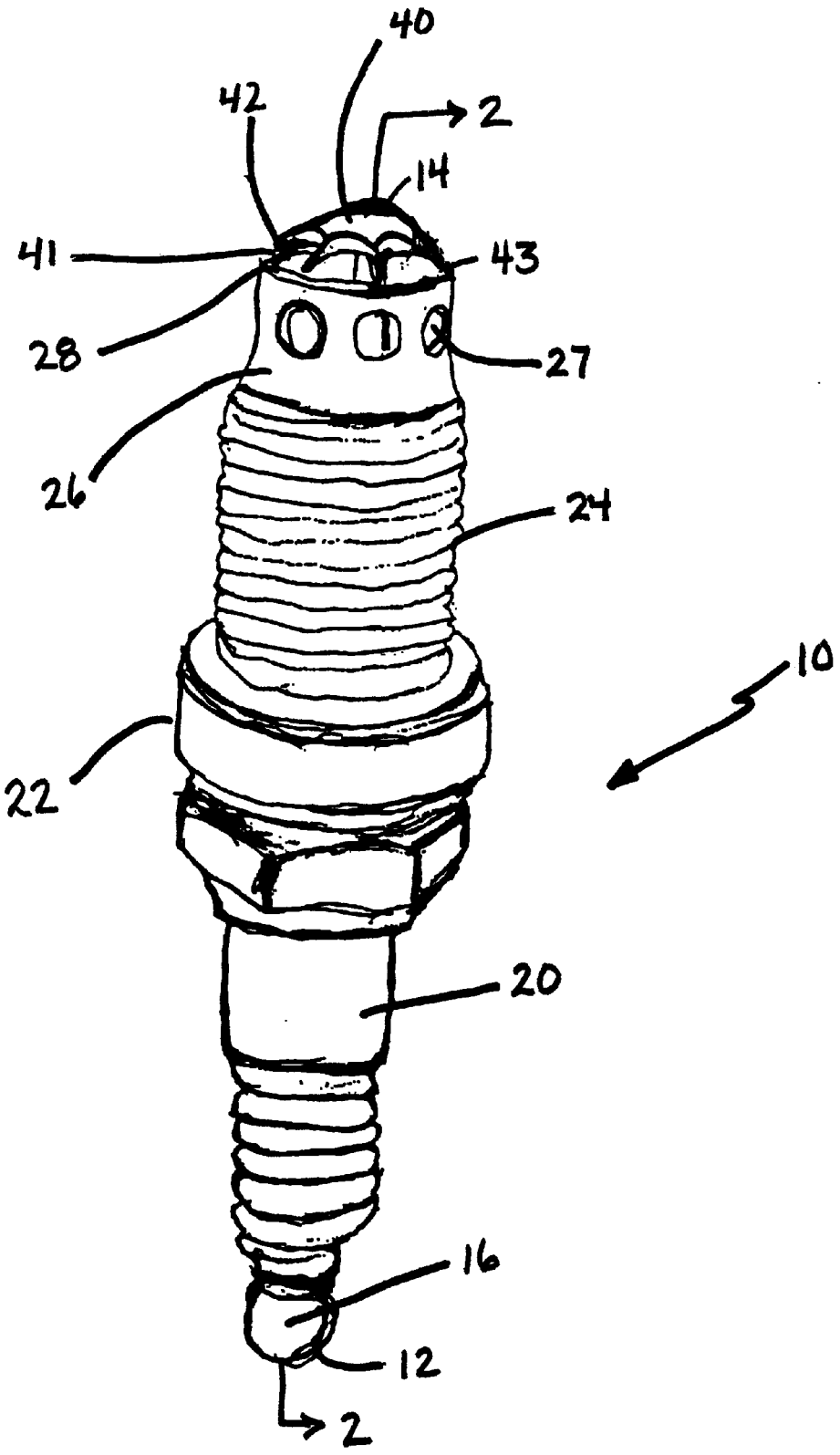
FIG. 1 is a perspective view of a spark plug according to a representative embodiment of the present invention.
Figure 2:
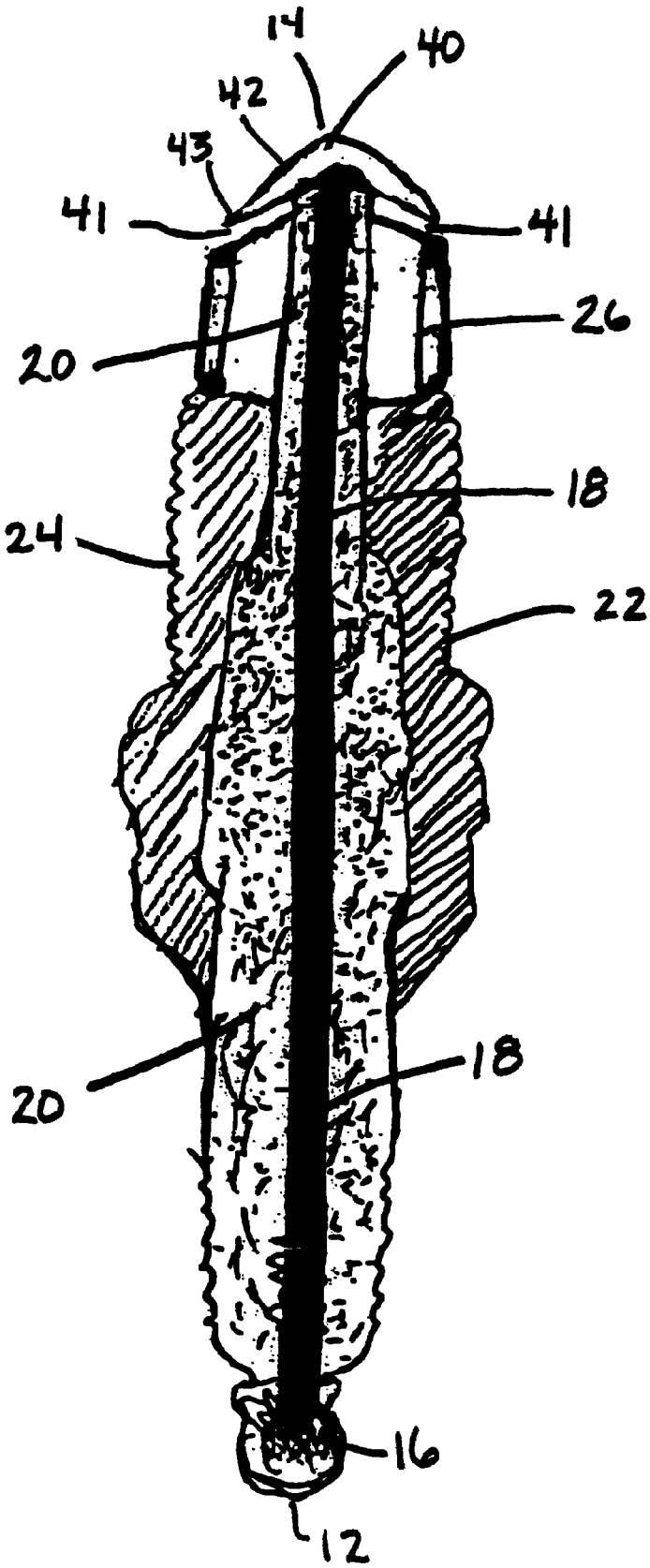
FIG. 2 is a cross-sectional view of the spark plug shown in FIG. 1.

FIGS. 1 and 2 show a perspective view and a cross-sectional view, respectively, of a spark plug 10, according to a representative embodiment of the present invention. Spark plug 10 has a proximal end 12 and a distal end 14 and is shown in FIGS. 1 and 2 substantially inverted from its orientation in its typical operational state. Disposed at proximal end 12 is a metallic connection terminal 16 for attaching spark plug 10 to a spark plug wire. Connector 16 is electrically coupled to central wire 18, which extends through the center of spark plug 10 and connects to electrically conductive cap 40 at the distal end 14 of spark plug 10. As shown, in the present embodiment of the invention cap 40 is star-shaped, having plural radially extending projections 42 that are bent downwardly such that cap 40 generally has a dome-shaped configuration. As noted in more detail below, it is not critical that cap 40 be star-shaped.

Similarly, it should be noted that cap 40 need not be dome-shaped and instead may be flat, with the precise configuration of cap 40 generally being determined based on the geometry of the engine cylinder (as defined in part by the motion of the corresponding piston) into which spark plug 10 is to be used. In this regard, a dome-shaped cap often may facilitate atomization of gasoline in the cylinder, as well as manipulating gas flow to provide additional cooling. However, the use of a dome-shaped cap might in some cases be precluded or made impractical by spatial considerations.

In any event, each projection 42 terminates in an end point 43 which in the current embodiment is a relatively sharp point. In alternate embodiments (as described in more detail below), any or all of end points 43 may be more blunted or squared off. The length and other geometric configurations of each projection 42, as with many of the other configurations and dimensions of spark plug 10, preferably are selected to locate the sparks within the correct firing zone and to appropriately shape the resulting sparks to improve combustion efficiency.

An outer metallic shell 22 functions as the ground electrode for spark plug 10. Shell 22 includes a threaded portion 24 for threading into the engine block and a collar 26 having a distal end surface 28 that functions as a firing ring for receiving sparks from the various points 43 of star-shaped cap 40. Preferably, collar 26 is sized so as to place the resulting sparks within a desired firing zone, subject to piston head clearance considerations. Preferably, firing ring 28 is approximately 0.060 inch wide. A ceramic or other insulating material 20 provides electrical isolation between central wire 18 and shell 22.

Collar 26 and firing ring 28 may be separately manufactured and then subsequently attached to the remainder of outer shell 22, such as by welding. However, more preferably, all of outer shell 22 is formed as a single unitary piece. Cap 40 generally is manufactured separately and bonded to the distal end of central electrode 18, as discussed in more detail below. The configuration of spark plug 10 provides for a gap 41 between the end point 43 of each projection 42 and firing ring 28. Typically, spark plug 10 will be manufactured so that gap 41 is approximately 0.060 to 0.070 inch.

In the present embodiment, collar 26 includes holes 27 which can be used to manipulate the gas flow within an engine cylinder, thereby manipulating the shape of the spark, otherwise optimizing combustion efficiency and/or enhancing cooling. The number, location and sizes of the holes 27 preferably are based on the engine into which the spark plug 10 will be inserted. In certain engines, the use of holes 27 can alter the gas flow patterns so as to provide cooling and/or to shape the resulting spark (e.g., to produce a desired curved shape, as described in more detail below). The provision of holes 27 in the this manner often can increase the curvature of a spark, thereby resulting in more complete combustion within an engine cylinder. However, it is noted that for certain engines, the optimal solution will be to omit holes 27 entirely.

Figure 3:
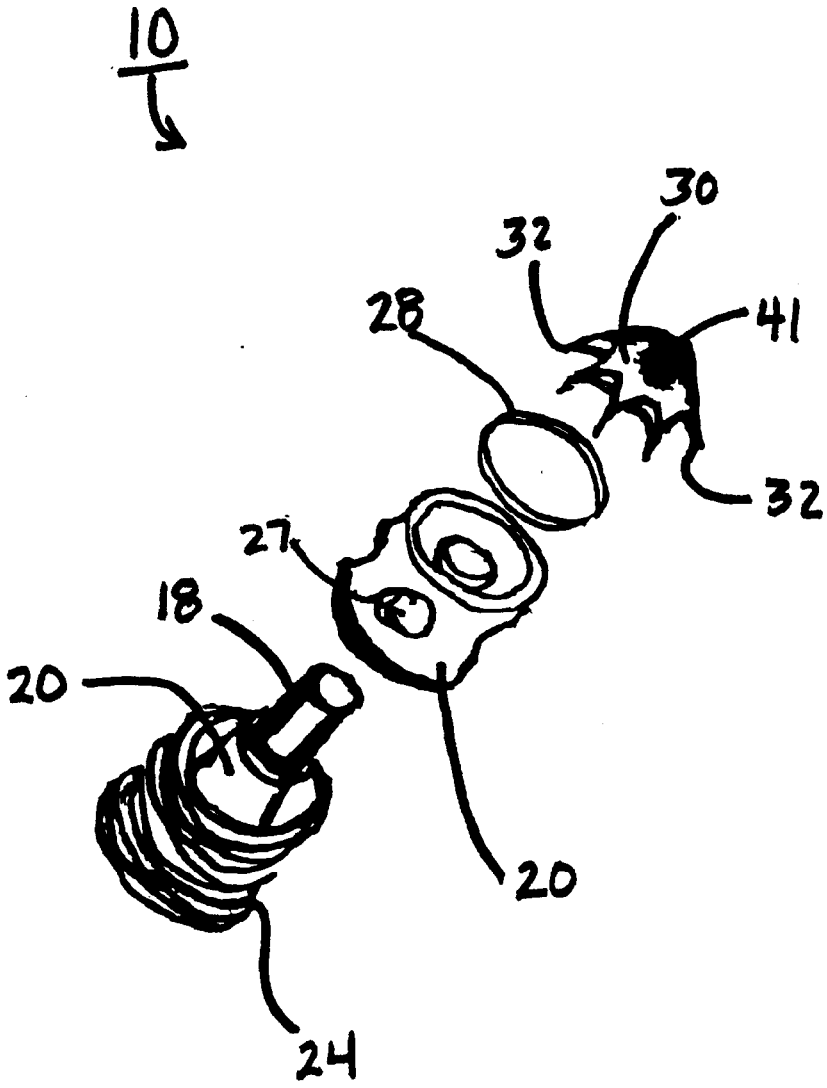
FIG. 3 is an exploded and partially cut-away view of a portion of the spark plug shown in FIG. 1.

FIG. 3 is an exploded and partially cut-away view of a portion of spark plug 10. In the embodiment shown in FIG. 3, collar 26 is detachable from threaded portion 24 of shell 22. However, as noted above, it is preferable to form collar 26 integrally with the other portions of shell 22. Similarly, in the embodiment shown in FIG. 3, firing ring 28 is detachable from the remainder of collar 26. However, it is also possible, and generally preferable, simply to use the top surface of collar 26 as firing ring 28.

Figure 4:
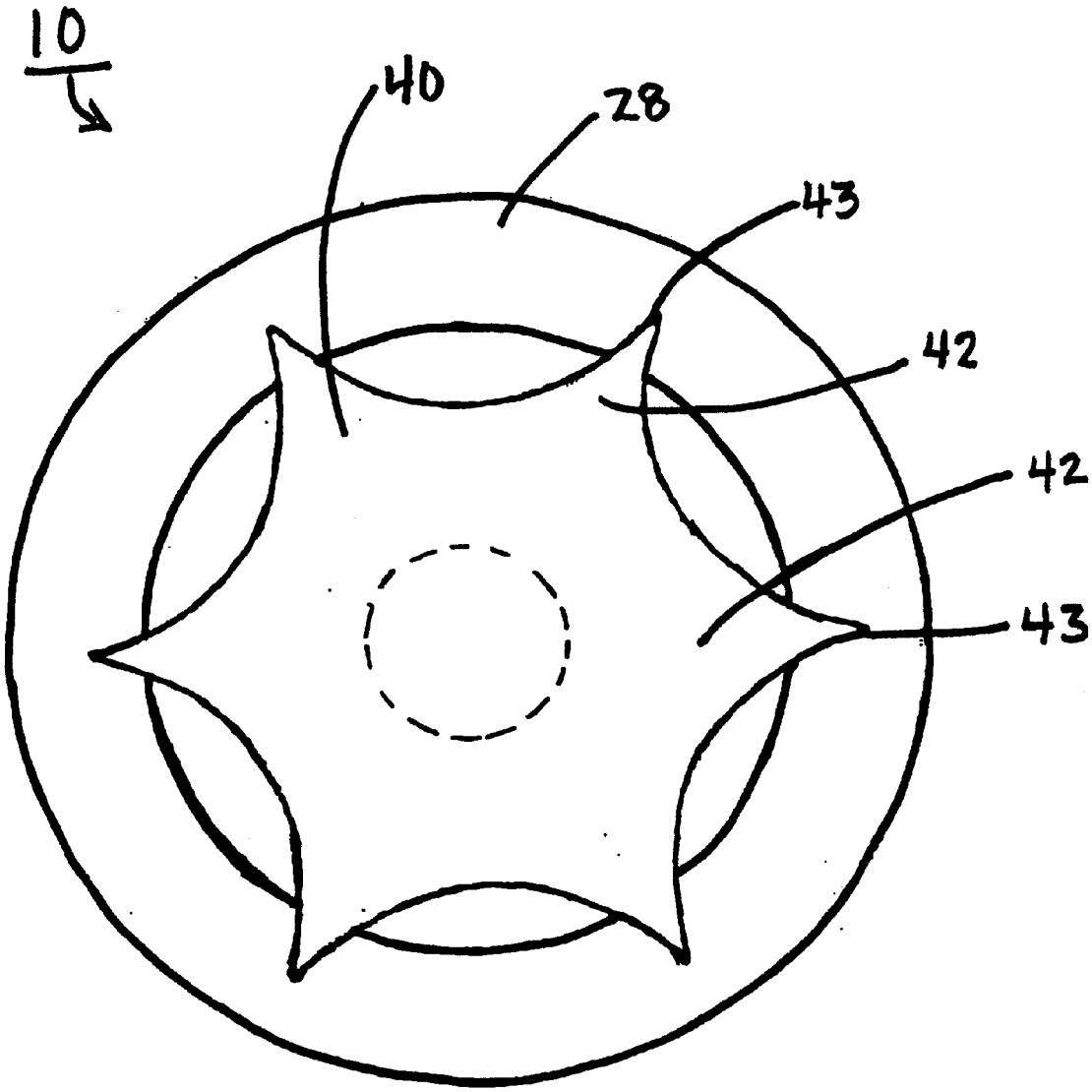
FIG. 4 is a bottom plan view of a spark plug according to the present invention.

FIG. 4 is a bottom plan view of a portion of a spark plug 10 according to a representative embodiment of the present invention. As shown in FIG. 4, cap 40 has plural pointed projections 42 extending from its central portion. The end point 43 of each projection 42 preferably lies above a point that is located at approximately 50% of the width of firing ring 28. Such positioning often will cause the spark between points 43 and firing ring 28 to bend outwardly at point 43 and then back inwardly at firing ring 28 (i.e., such that the spark has a curved or "D" shape). Such a curved spark generally is desirable for increasing combustion efficiency.

Figure 6:
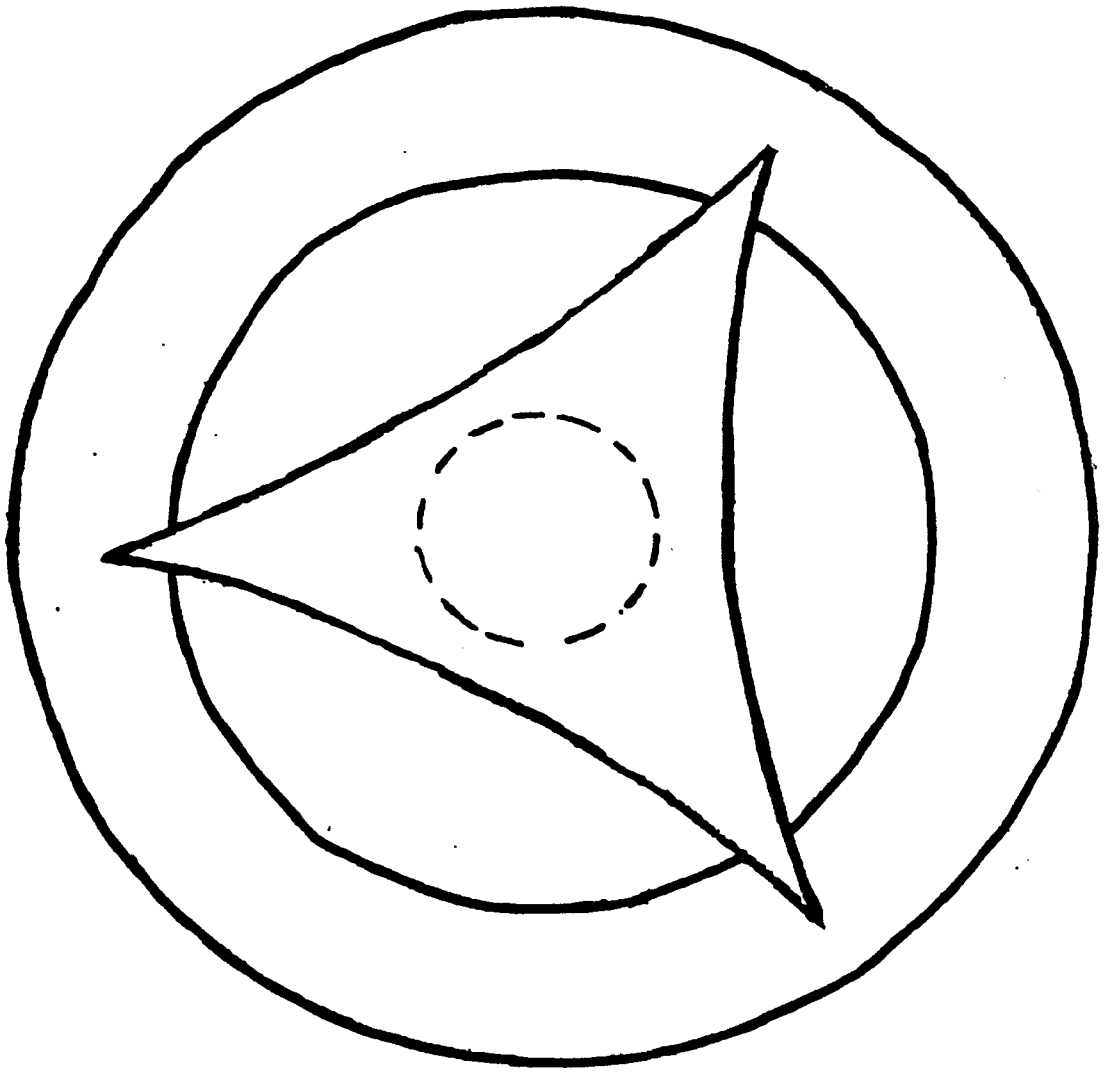
FIG. 6 is a bottom plan view of a spark plug according to the present invention having a three-pointed cap.
Figure 7:
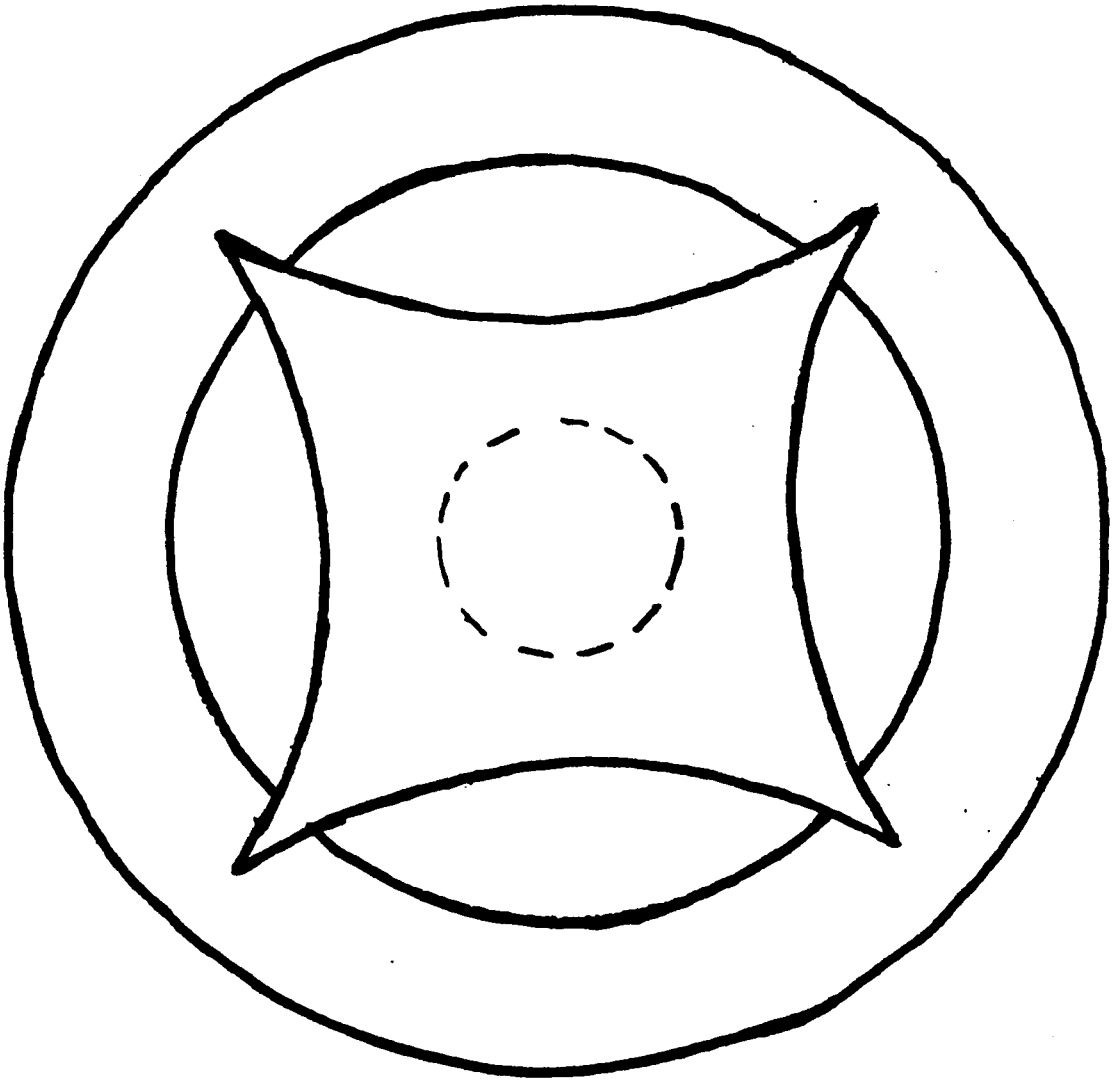
FIG. 7 is a bottom plan view of a spark plug according to the present invention having a four-pointed cap.

It should be noted that although star-shaped cap 40, shown in FIG. 4, has six radially extending projections 42, the number of projections used will vary based upon the type of engine with which the spark plug will be used. For example, the number of projections 42 may be any number from 2 to 14. As a result, cap 40 will not always be star-shaped (e.g., when it includes only 2 to 5 projections). Illustrations of such alternative embodiments are set forth in FIGS. 5 to 7.

Figure 5:
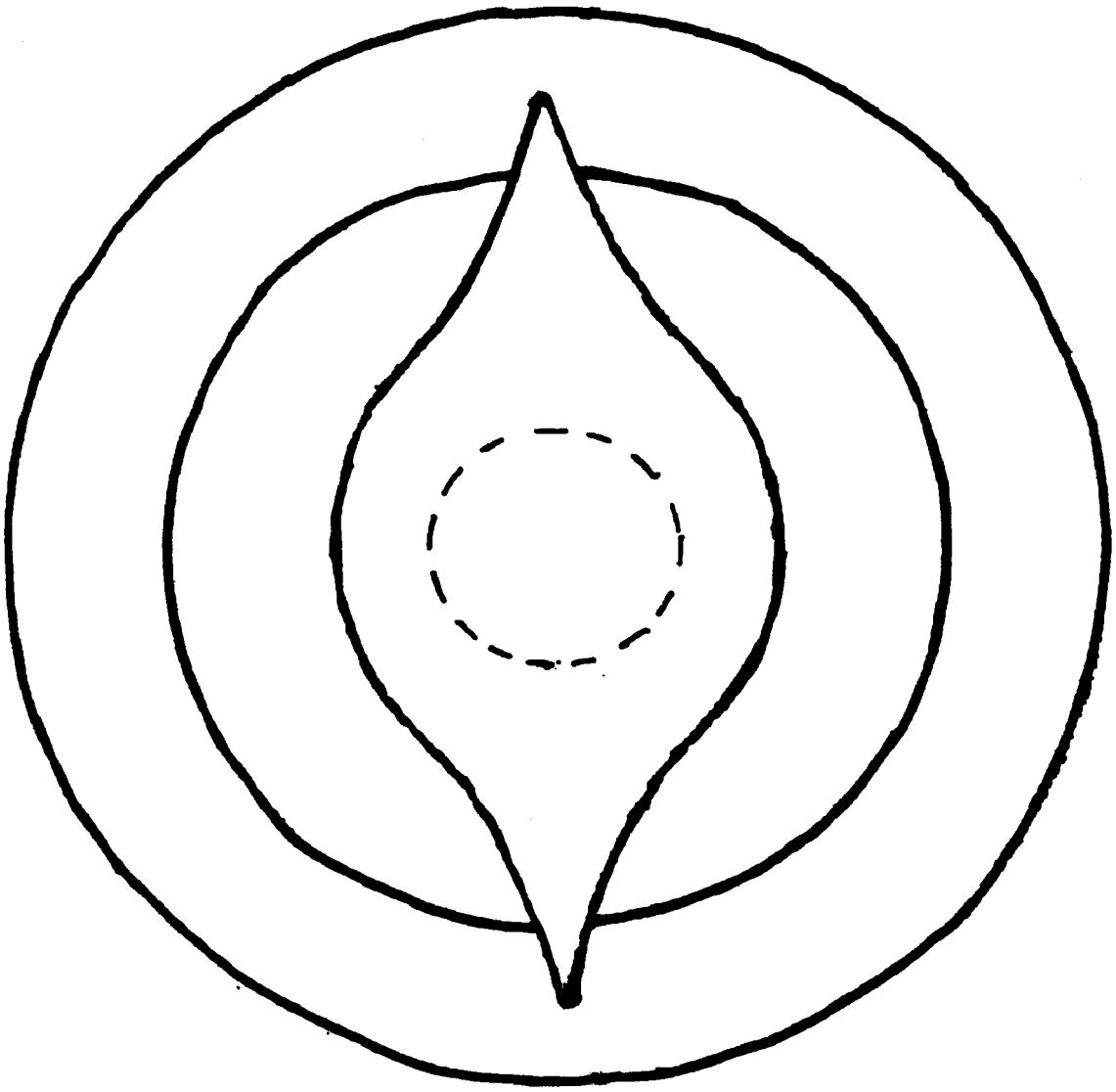
FIG. 5 is a bottom plan view of a spark plug according to the present invention having a two-pointed cap.
Figure 8:
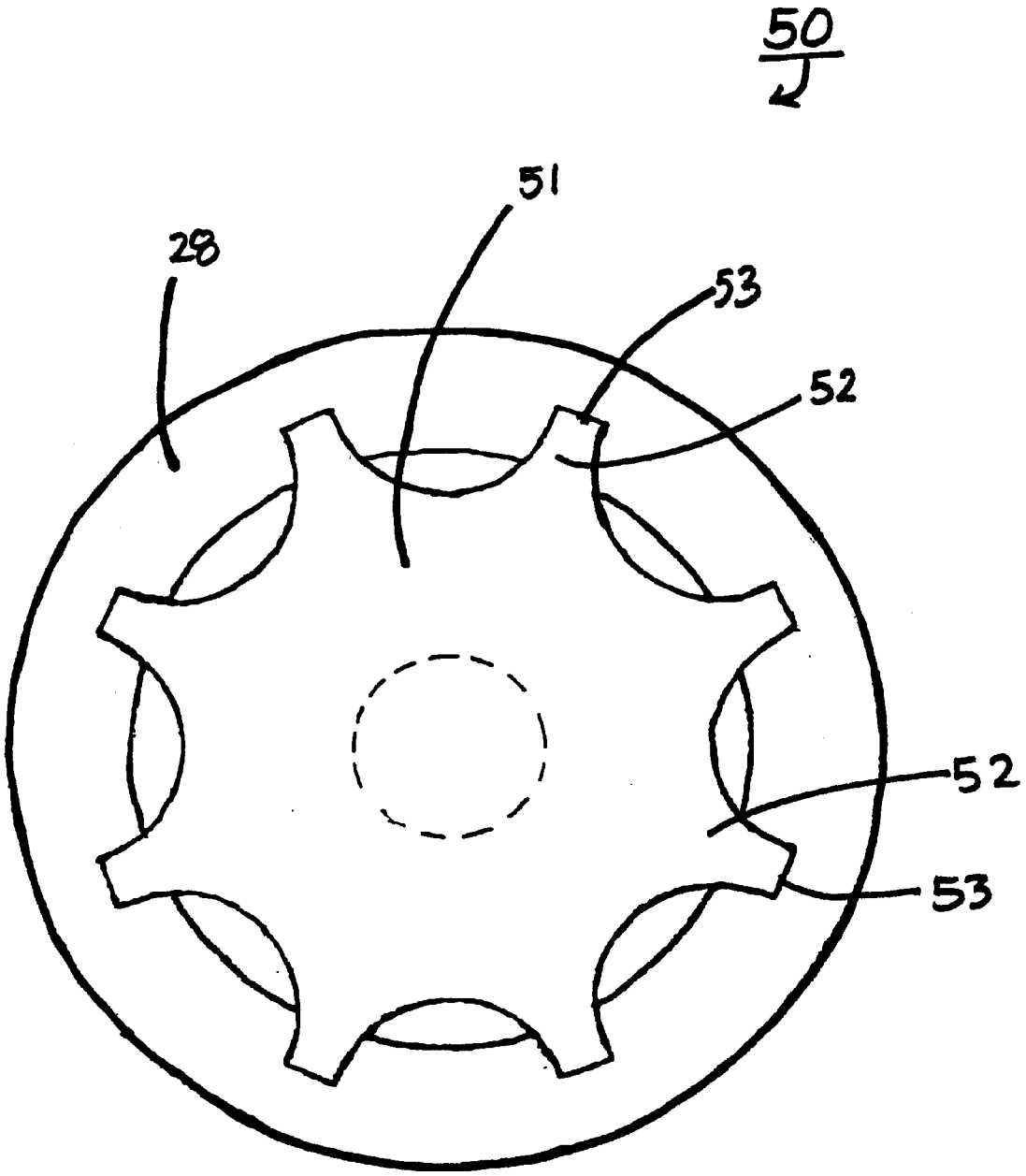
FIG. 8 is a bottom plan view of a portion of a spark plug according to an alternate embodiment of the present invention in which the points of the cap are blunted.

FIG. 8 illustrates the bottom plan view of a portion of a spark plug 50 according to an alternate embodiment of the present invention. In FIG. 5, cap 51 has plural radial projections 52. However, the points 53 at the ends of the radial projections 52 are squared off, flattened or blunted, rather than being sharply pointed, as are projection end points 43 shown in FIG. 4. The cap design illustrated in FIG. 8, when used in a spark plug according to the present invention, often will result in multiple sparks emanating from each projection 52. While desirable in certain cases (e.g., high-performance vehicles), such a design often will also result in higher engine temperatures. Accordingly, the precise dimensions of the projection end points preferably are optimized for the intended use. Once again, although a particular number of radial projections 52 are shown in FIG. 8, it should be understood that any number of radial projections 52 may instead be used.

Figure 9:
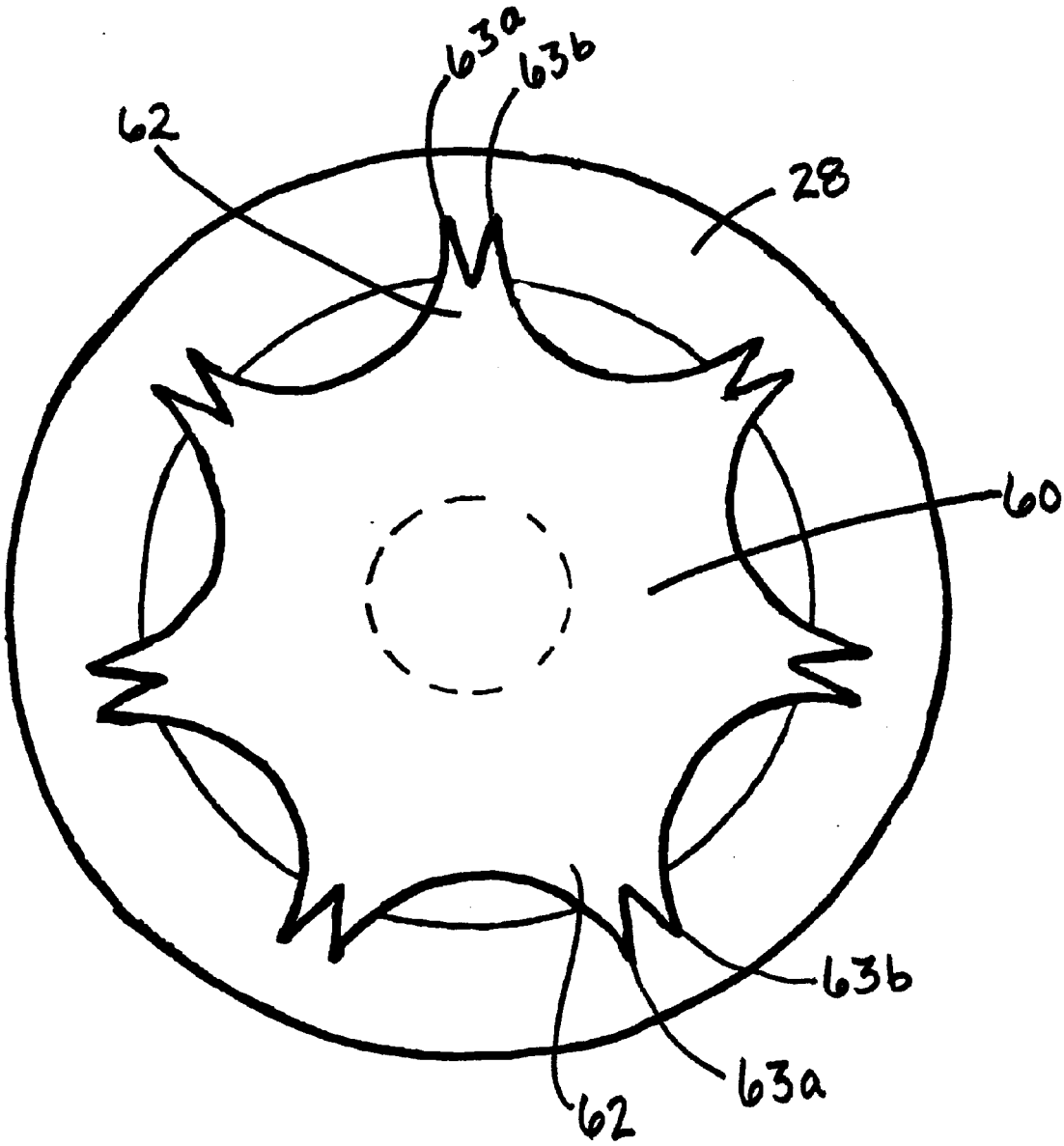
FIG. 9 is a bottom plan view of a portion of a spark plug according to an alternate embodiment of the present invention in which the points of the cap are forked.

FIG. 9 illustrates the bottom plan view of a portion of a spark plug 60 according to a third representative embodiment of the present invention. In this embodiment, each projection 62 of cap 61 has an end point 63 that is forked, resulting in two separate subprojections 63*a* and 63*b*. In use, a spark plug according to the present invention having a cap shape illustrated in FIG. 9 often can provide a spark from each subprojection 63*a* and 63*b*. Once again, any number of projections 62 can be provided for cap 61.

Figure 10:
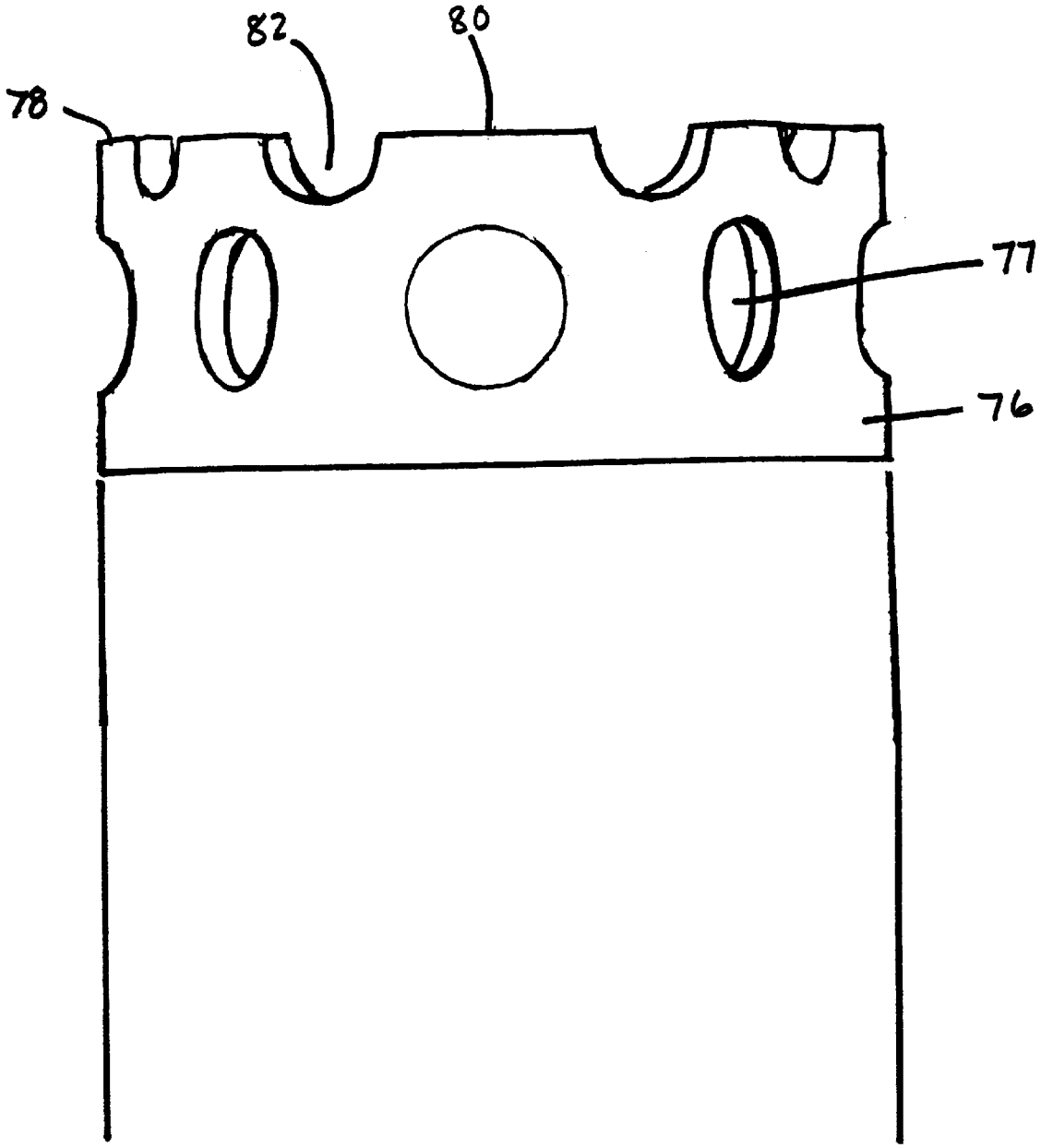
FIG. 10 illustrates a side view of the collar portion of a spark plug according to an alternate embodiment of the present invention in which the firing ring includes indented portions.

FIG. 10 illustrates a collar 76 that may be used in place of collar 26, shown in FIG. 1. As with collar 26, collar 76 includes holes 77. In addition, collar 76 includes a firing ring 78 that has alternating flat portions 80 and indented portions 82, forming a crown-like structure. Preferably, flat portions 80 are aligned with the endpoints of the projections extending from the cap. More preferably, each such endpoint is centered just above the midpoint for a corresponding flat portion 80. As with holes 27 and 77, the dimensions of flat portions 80 and indented portions 82, as well as the decision as to whether or not to include indented portions 82 at all, preferably is made based on gas flow patterns within the engine cylinder and/or the desired shape of the resulting spark. The crown-like structure illustrated in FIG. 10 has been found to be best suited for use in air-cooled and flat-head engines.

Figure 11:
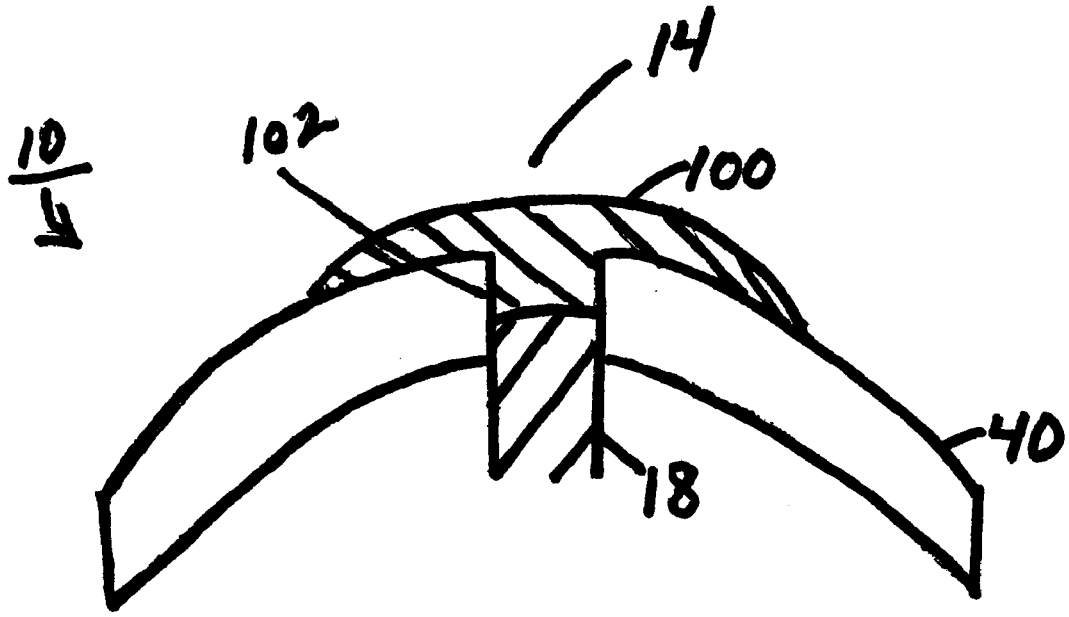
FIG. 11 is a cross-sectional view of the cap portion of a spark plug according to a representative embodiment of the present invention.

FIG. 11 illustrates an enlarged cross-section of the portion of spark plug 10 near its distal end 14 where central electrode 18 attaches to the cap 40. Although spark plug 10 is illustrated in FIG. 11, the particular designation of the spark plug shown in FIG. 11 is for ease of description only. It should be understood that the illustrated configuration may be used in any other spark plug according to the present invention, such any as of the other embodiments described above. As shown in FIG. 11, the central electrode 18 extends partly into cap 40. In the preferred embodiment of the invention, central electrode 18 extends into cap 40 approximately 40–50% of the thickness of cap 40 through a hole 102 in the center of cap 40. Just above central electrode 18 is an amount of filler material 100 that has been built up over the top surface of cap 40 and tapers down toward the edges of cap 40 in a canopy shape. Preferably, filler material 100 has a lower conductivity (higher resistivity) than cap 40 and, in certain embodiments, a lower conductivity than either of central electrode 18 or cap 40. In addition, as described in more detail below, filler material 100 preferably has been deposited as a fusion material for fusing central electrode 18 to cap 40. In the preferred embodiment of the invention, filler material 100 has a conductivity that is at least 20% lower than the conductivity of cap 40. More preferably, the conductivity of filler material 100 is at least 30%, 40%, 50%, 60%, 70% or 80% lower than that of cap 40.

The use of a lower conductivity filler material in the foregoing manner has been found to greatly facilitate the ability of spark plug 10 to produce simultaneous sparks from its various radially extending projections 42. It is noted that the central electrode 18, cap 40 and filler material 100 generally are described herein as being separate elements (particularly in view of the preferred method of manufacturing spark plug 10 discussed below). However, it is also possible to consider any combination of such separate elements as a single element. For example, filler material 100 may be considered to be a part of cap 40.

The preferred method for manufacturing spark plug 10 will now be discussed. Although the following discussion refers to spark plug 10, such references are for ease of description only. It should be understood that the following manufacturing methods may be used for any other spark plug according to the present invention, such any as of the other embodiments described above.

Referring back to FIG. 1, most of the structure of spark plug 10 is identical to that of a conventional spark plug. Accordingly, much of spark plug 10 can be manufactured using conventional techniques. As noted above, collar portion 26 can be either welded onto shell 22 or can be integrally formed with threaded portion 24 to provide shell 22. The main differences in manufacturing a spark plug according to the present invention as compared with a conventional spark plug generally will be in the formation of cap 40 and the attachment of cap 40 to central electrode 18.

Figure 12:
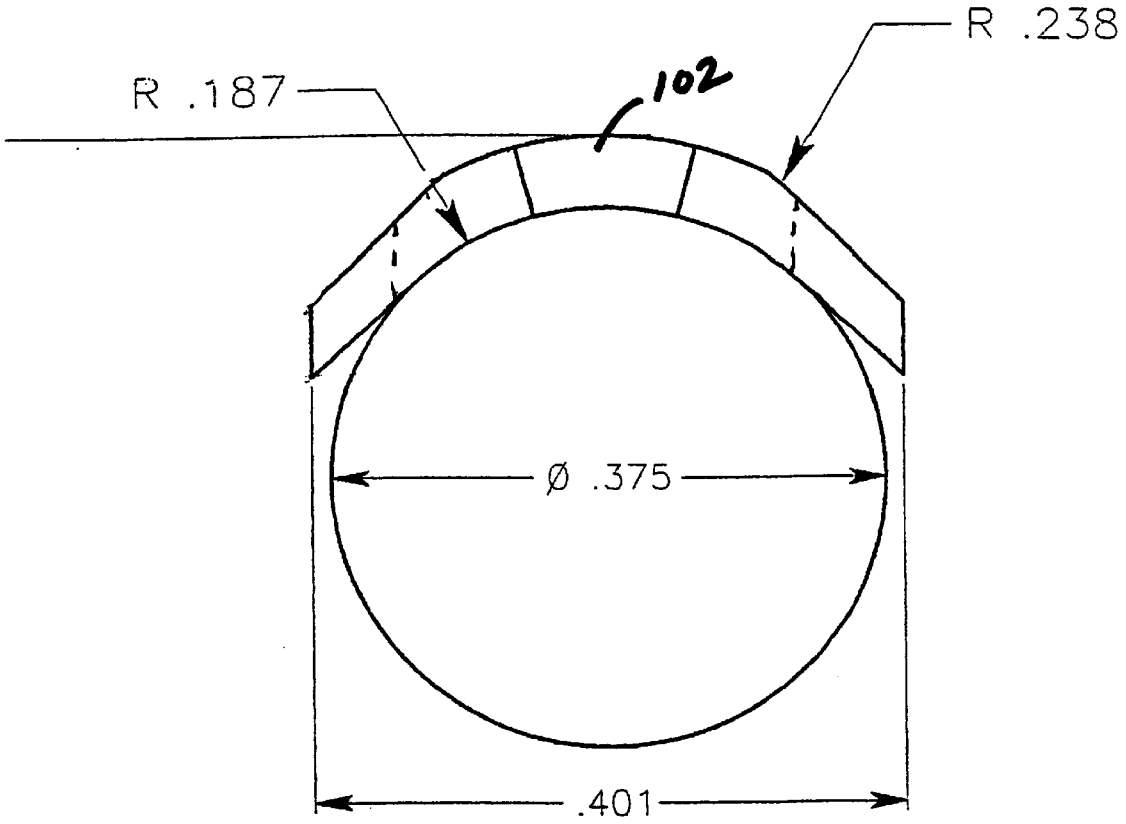
FIG. 12 illustrates a star-shaped cap for use in a spark plug according to the present invention bent into a dome shape on a ⅜ inch ball.

In the preferred embodiment of the invention, cap 40 is simultaneously: punched into a star (or multi-point) shape and punched with a center hole 102 starting from a flat piece of metal. Preferably, the sheet of metal from which the cap is formed is approximately 0.050 inch in thickness and has a Rockwell hardness of 50 to 55 Rockwell A. When a dome-shaped cap is desired, the cap is punched onto a ball (or other curved surface), causing it also to be simultaneously bent into the desired dome shape. This technique is illustrated in FIG. 12, which shows cap 40 bent onto the surface of a ⅜ inch diameter ball after completion of the punching operation. It is noted that a ⅜ inch diameter ball preferably is used for 12 and 14 millimeter (mm) spark plugs, while a 5/16 inch diameter ball preferably is used for 10 mm spark plugs and a ½ inch diameter ball preferably is used for 18 mm spark plugs. Of course, if the cap is intended to be flat, it can be instead punched onto a planar surface.

Once cap 40 has been manufactured, it is inserted onto the distal end of central electrode 18. Preferably, hole 102 is sized so as to fit tightly around central electrode 18, as noted above, cap 40 preferably, is pushed onto central electrode 18 through hole 102 to a distance of approximately 40–50% of the thickness of cap 40. A hydrogen fusion process is then initiated. As cap 40 and central electrode 18 begin to melt and fuse together, a drop of fusion material 100 is deposited and swirled to form the tapered pattern shown in FIG. 8. The resulting structure is allowed to cool and then the deposited fusion material 100 is ground down to form a smooth surface.

In the preferred embodiment of the invention, the cap material is comprised of 71 to 79% nickel, 15 to 19% chromium, with the balance being iron (in all cases, percentages are by weight), resulting in a resistivity of approximately 200 ohm-inch. Preferably, the attachment medium 100 is approximately 52 to 55% nickel, 16% chromium, and the remainder iron, resulting in a resistivity of approximately 750–850 ohm-inch. In an alternative embodiment, the attachment medium 100 comprises a minimum of 93% nickel, a maximum of 0.25% copper, a maximum of 6% iron and a maximum of 5% manganese, resulting in a resistivity of approximately 550 ohm-inch. Conventional materials may be used for the central electrode 18, although it is often desirable to use a greater proportion of nickel, such as 76 to 78%, resulting in a resistivity of approximately 600–615 ohm-inch. In any event, however, the materials used for the central electrode 18, cap 40 and fusion material 100 preferably are selected: (i) to achieve the relative conductivities described above, (ii) such that the materials will fuse together readily, and (iii) such that each material has an operating temperature in the range of approximately 1800–2200 degrees Fahrenheit, generally requiring a melting temperature in the range of approximately 2600–2800 degrees Fahrenheit. The specific materials identified above have been found to work well for cap 40 and fusion material 100. However, other materials may be used instead.

Figure 13:
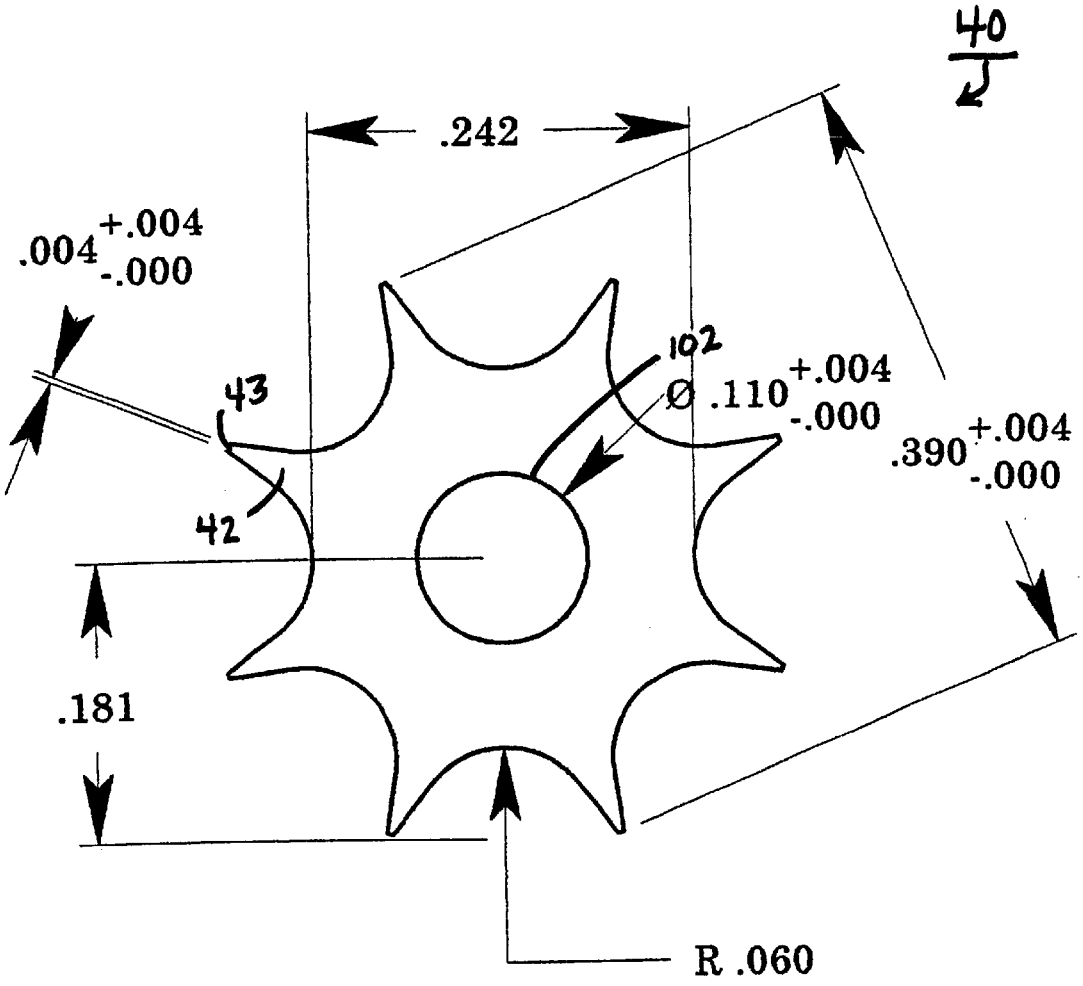
FIGS. 13 through 16 illustrate dimensions for star-shaped caps for use in spark plugs according to the present invention.
Figure 14:
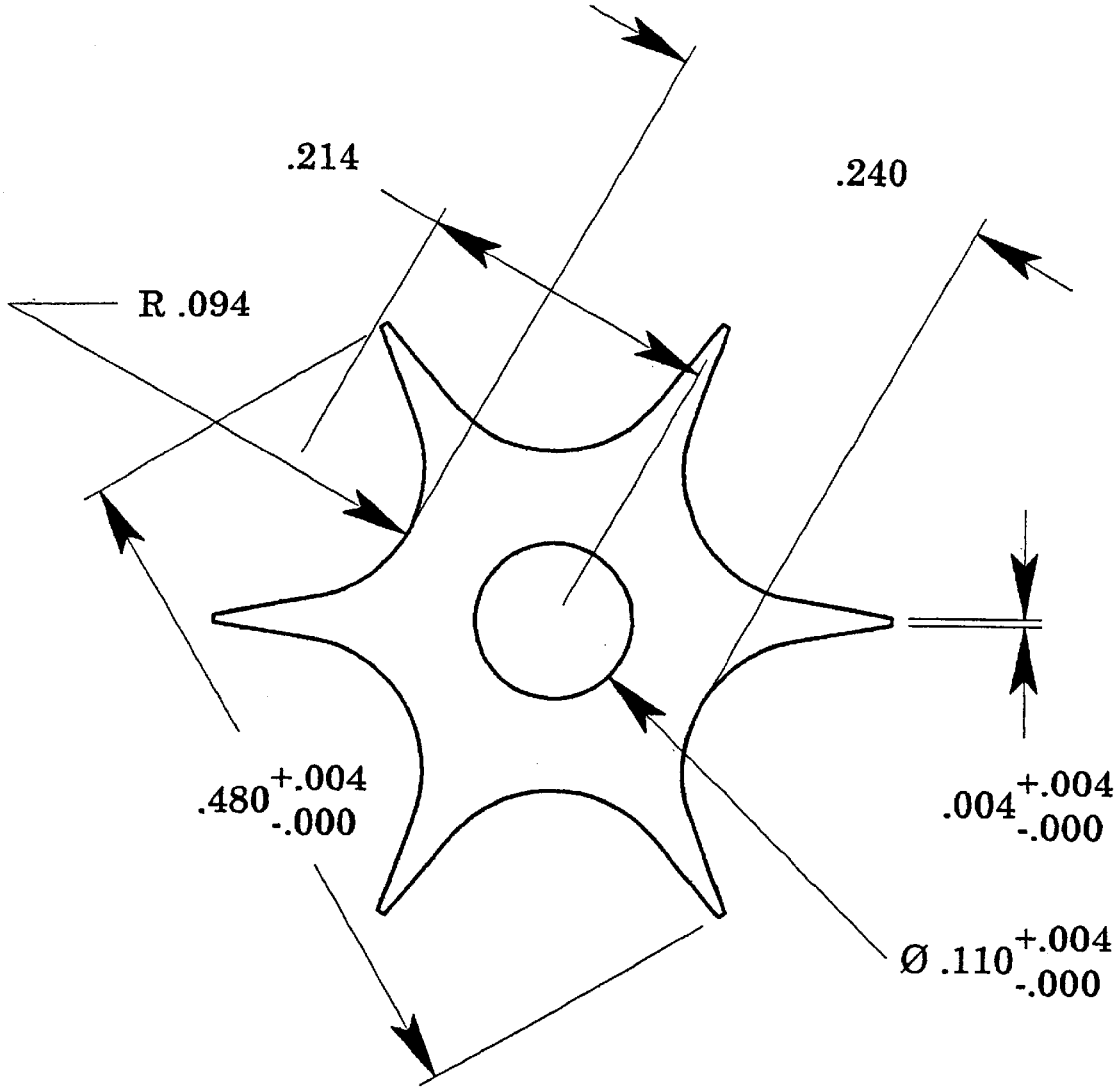
Figure 15:
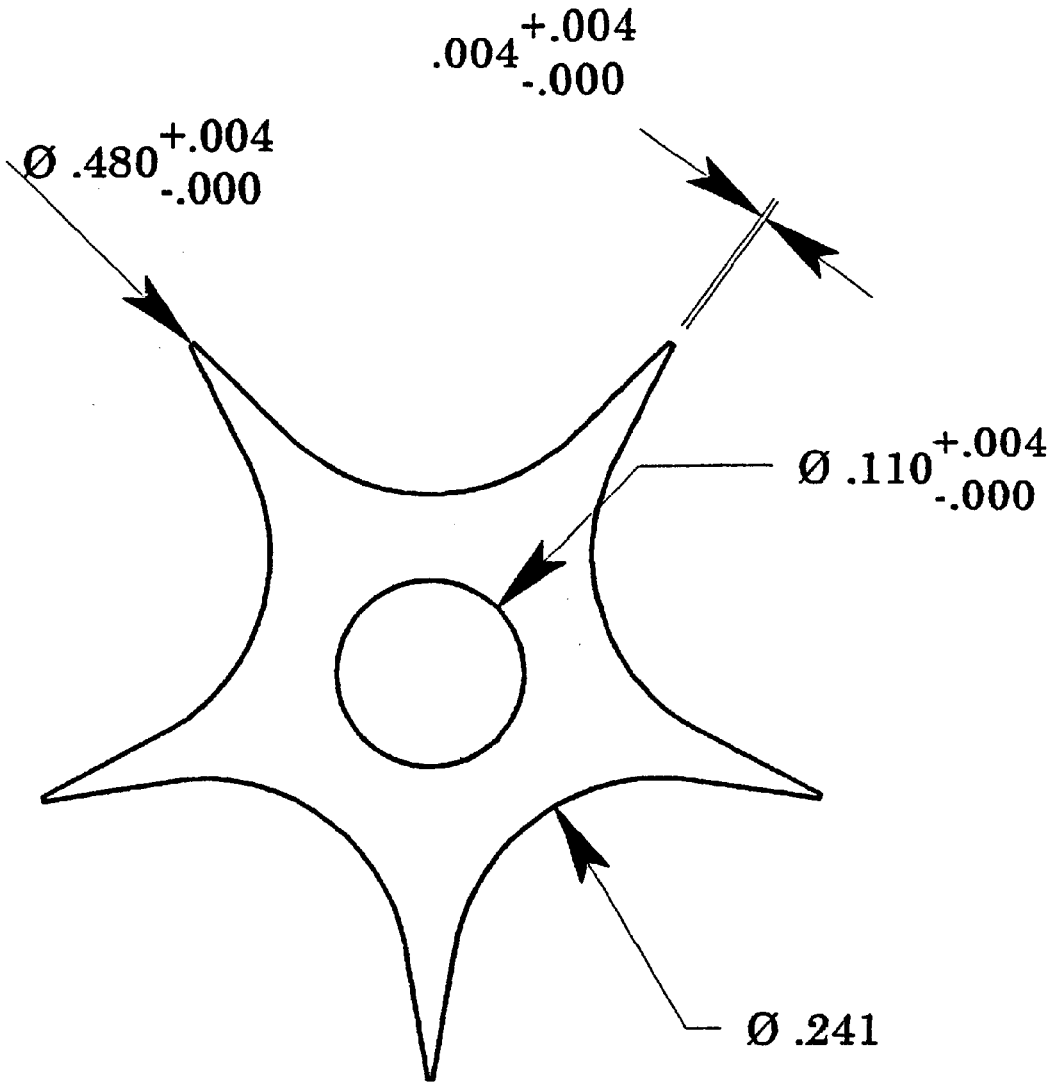
Figure 16:
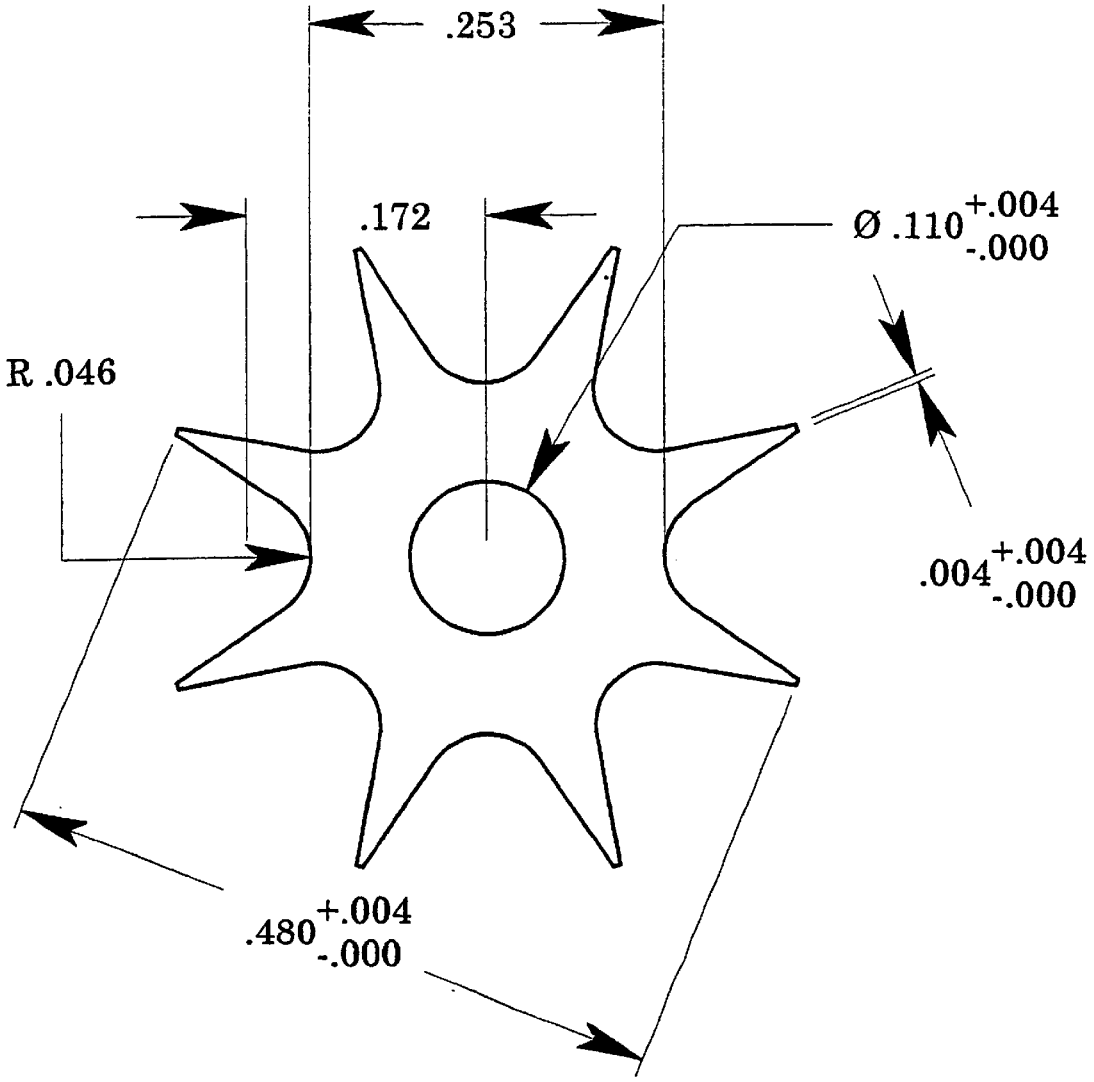

FIG. 13 shows the dimensions for cap 40 if punched onto a flat surface for a 12 mm spark plug according to a representative embodiment of the present invention. Specifically, hole 102 has a diameter of from 0.110 to 0.114 inch, the curvature radius between projections is 0.060 inch, the diameter of the cap 40 is 0.390 to 0.394 inch, and the width of the end point 43 of each projection 42 is between 0.004 and 0.008 inch. If squared-off or blunted end points are desired, then the width of the end points might instead range, for example, between 0.008 and 0.065 inch. FIGS. 14 to 16 show cap dimensions (in inches) for various representative embodiments of 14 mm spark plugs. A cap having the dimensions or approximately the same dimensions shown in FIGS. 13 to 14 may be used in certain embodiments of the invention.

Additional Considerations

Other variations of the spark plugs described above also are possible. For instance, in certain embodiments it may be preferable to utilize platinum tips for some or all of the projection end points. Such tips may be applied using any conventional techniques.

Thus, although the present invention has been described in detail with regard to the exemplary embodiments thereof and accompanying drawings, it should be apparent to those skilled in the art that various adaptations and modifications of the present invention may be accomplished without departing from the spirit and the scope of the invention. Accordingly, the invention is not limited to the precise embodiments shown in the drawings and described above. Rather, it is intended that all such variations not departing from the spirit of the invention be considered as within the scope thereof as limited solely by the claims appended hereto.

Also, several different embodiments of the present invention are described above, with each such embodiment described as including certain features. However, it is intended that the features described in connection with the discussion of any single embodiment are not limited to that embodiment but may be included and/or arranged in various combinations in any of the other embodiments as well, as will be understood by those skilled in the art.

What is claimed is:

1. A spark plug, comprising:

(a) a central electrode having a proximal end and a distal end;

(b) a cap having a central portion and plural projections extending radially from the central portion, wherein (i) the cap has a proximal side and a distal side and the proximal side of the cap is attached to the distal end of the central electrode, (ii) the cap is electrically conductive, having a first electrical conductivity, (iii) a central portion of the cap defines a hole and has a thickness in a location of the hole, and (iv) the central electrode extends into the hole of the cap but terminates prior to the distal side of the cap; and (c) a filler material disposed within a portion of the hole that is not occupied by the central electrode, wherein the filler material has a second electrical conductivity that is lower than the first electrical conductivity.

2. A spark plug according to claim 1, wherein the central electrode extends into the hole approximately 50% of the thickness of the central portion of the cap.

3. A spark plug according to claim 1, wherein the cap has at least four projections.

4. A spark plug according to claim 1, wherein each of the projections terminates in a sharp point.

5. A spark plug according to claim 1, wherein plural of the projections terminate in more than one sharp point.

6. A spark plug according to claim 1, wherein the central electrode, the cap and the filler material have been fused together.

7. A spark plug according to claim 1, further comprising a firing ring disposed at a gap from the from side of the cap and having a width, and wherein approximately 50% of the width of the firing ring lies outside of a diameter of the cap.

8. A spark plug according to claim 1, wherein the cap is dome-shaped.

9. A spark plug according to claim 1, wherein the filler material occupies substantially all of the hole not occupied by the central electrode.

10. A spark plug according to claim 9, wherein the filler material rises above the distal side of the cap.

11. A spark plug according to claim 9, wherein the filler material extends beyond an area on the distal side of the cap where the hole is located.

12. A spark plug according to claim 1, wherein the second electrical conductivity is at least 20% lower than the first electrical conductivity.

13. A spark plug according to claim 12, wherein the second electrical conductivity is between 20% and 50% of the first electrical conductivity.

14. A spark plug, comprising:

(a) a central electrode having a proximal end and a distal end; and (b) a cap having a central portion and plural projections extending radially from the central portion, wherein (i) the cap has a proximal side and a distal side and the proximal side of the cap is attached to the distal end of the central electrode, (ii) the cap is comprised mostly of a first material having a first electrical conductivity and also of a second material having a second electrical conductivity that is lower than the first electrical conductivity, and (iii) the second material is disposed toward the distal side of the cap.

15. A spark plug according to claim 14, wherein the second electrical conductivity is at least 20% lower than the first electrical conductivity.

16. A spark plug according to claim 14, wherein the second electrical conductivity is at least 50% lower than the first electrical conductivity.

17. A spark plug according to claim 14, wherein the second material is configured in a mushroom shape, having a canopy and a stem.

18. A spark plug according to claim 17, wherein the stem is surrounded by the first material.

19. A spark plug according to claim 14, wherein the second material is comprised of at least 70% nickel.

20. A spark plug according to claim 19, wherein the second material is comprised of at least 93% nickel.

21. A spark plug according to claim 14, further comprising a firing ring disposed beneath the plural projections.

22. A spark plug according to claim 21, wherein the firing ring sits atop a hollow cylindrical wall having plural holes.

23. A spark plug according to claim 21, wherein the firing ring has plural indentations.

24. A method for manufacturing a spark plug, comprising:

(a) fabricating a cap having a central portion and plural projections extending radially from the central portion, wherein the central portion of the cap defines a hole through the cap, the hole having a depth;

(b) inserting an electrode into the hole, but only through a portion of the depth of the hole;

(c) heating the cap and the electrode so that fusion begins to occur; and (d) depositing attachment material so as to fill at least a portion of the depth of the hole not occupied by the electrode.

25. A spark plug according to claim 24, wherein said step (d) is performed by hydrogen fusion.

26. A spark plug according to claim 24, wherein the attachment material is deposited so as to fill all of the depth of the hole not occupied by the electrode and is built up above a surface of the cap.

27. A spark plug according to claim 24, wherein the attachment material has a conductivity that is at least 50% lower than a conductivity of the cap.

28. A spark plug according to claim 24, wherein the attachment material is fused to the cap.

29. A spark plug according to claim 24, wherein both the cap and the attachment material are capable of being subjected to temperatures of 1900° F. for long periods of time without annealing or becoming brittle.

30. A spark plug according to claim 24, wherein the attachment material has a lower conductivity than the cap.

31. A spark plug according to claim 30, wherein the attachment material has a conductivity that is at least 20% lower than a conductivity of the cap.

32. A spark plug according to claim 24, wherein said step (a) comprises bending the cap into a shape of a dome so that the plural projections extend downwardly.

33. A spark plug according to claim 32, further comprising a step of providing a firing ring below the plural projections.

34. A spark plug according to claim 33, wherein the firing ring sits atop a hollow cylindrical wall having plural holes.

35. A spark plug according to claim 34, wherein the plural holes have been formed so as to enhance the outward curving of a spark between at least one of the plural projections and the firing ring.

36. A spark plug according to claim 33, wherein the firing ring has plural indentations.

37. A spark plug comprising:

(a) a central electrode having a distal end and a proximal end;

(b) an insulator surrounding the central electrode;

(c) a shell surrounding the insulator and having a wall portion extending at its distal end, wherein the wall portion has a proximal firing surface and defines a plurality of holes in the cylindrical wall thereof; and (d) a cap attached to the proximal end of said central electrode and having a plurality of projections protruding radially from the periphery thereof, wherein the central electrode, the insulator, and the shell are disposed in a concentric arrangement and the cap is concave, wherein the cylindrical extension and the cap are spaced apart to define a spark gap between said firing surface of the extension and said projections on the periphery of the cap, and wherein the cylindrical extension is configured such that said holes comprise between about 20% and 40% of the total surface area of said wall of said cylindrical extension.

* * * * *